US005622267A

United States Patent [19]

Hautala

[11] Patent Number: 5,622,267

[45] Date of Patent: Apr. 22, 1997

[54] METHOD AND PRESSURE SCREEN FOR SCREENING FIBRE SUSPENSION

[75] Inventor: Jouko Hautala, Tampere, Finland

[73] Assignee: Valmet Corporation, Helsinki, Finland

[21] Appl. No.: 596,204

[22] PCT Filed: Aug. 18, 1994

[86] PCT No.: PCT/FI94/00358

§ 371 Date: Feb. 16, 1996

§ 102(e) Date: Feb. 16, 1996

[87] PCT Pub. No.: WO95/06159

PCT Pub. Date: Mar. 2, 1995

[30] Foreign Application Priority Data

Aug. 20, 1993 [FI] Finland ..... 933690

[51] Int. Cl.[6] ..... B07B 1/04

[52] U.S. Cl. ..... 209/273; 209/305

[58] Field of Search ..... 209/17, 728, 729, 209/273, 305, 306, 300

[56] References Cited

U.S. PATENT DOCUMENTS

| | | | |
|---|---|---|---|
| 3,677,402 | 7/1972 | Holz | 209/273 X |
| 3,735,873 | 5/1973 | Bergstedt | 209/273 X |
| 3,785,495 | 1/1974 | Holz . | |
| 3,865,243 | 2/1975 | Salminen . | |
| 4,913,806 | 4/1990 | Hillström et al. . | |
| 4,968,417 | 11/1990 | Åhs . | |

FOREIGN PATENT DOCUMENTS

| | | |
|---|---|---|
| 309/67 | 6/1973 | Finland . |

*Primary Examiner*—D. Glenn Dayoan
*Attorney, Agent, or Firm*—Ladas & Parry

[57] ABSTRACT

In a method and pressure screen for screening fiber suspension, fiber suspension is passed through two successive screening stages (A, B) provided in the same pressure screen so that accept from the first screening stage (A) is passed to the second screening stage (B), and accept from the second screening stage (B) is removed from the pressure screen. Reject from the second screening stage (B) is returned to the supply side of the first screening stage (A) for rescreening. The pressure screen has a first screen cylinder (9) having an inlet space (V1) into which fiber suspension is introduced. A second screen cylinder (10) is provided at a distance from the first screen cylinder. Accept passed through the first screen cylinder (9) is passed into the inlet space (V5) of the second screen cylinder through a channel within the rotor (3) by pumping blades (5) attached to the rotor. The inlet space (V5) of the second screen cylinder (10) is positioned axially in succession with the inlet space (V1) of the first screen cylinder (9).

15 Claims, 4 Drawing Sheets

METHOD AND PRESSURE SCREEN FOR SCREENING FIBRE SUSPENSION

The invention relates to a method for screening fibre suspension at separate screening stages provided in a single pressure screen, wherein accept from the first screening stage is passed to the second screening stage, and accept from the second screening stage and reject formed in the screening are removed from the pressure screen.

The invention further relates to a pressure screen for screening fibre suspension, comprising a housing, a rotor mounted for rotation within the housing, a first inlet space formed within the housing and defined on one side by a first screen cylinder, a first intermediate space formed on the other side of the first screen cylinder, a second inlet space defined on one side by a second screen cylinder mounted coaxially with the first screen cylinder, a discharge space formed outside the second screen cylinder, and a supply conduit for introducing fibre suspension to be screened into the screen, the first intermediate space communicating with the second inlet space for passing the accept passed through the first screen cylinder to the second screen cylinder, the inlet space being connected to a reject discharge conduit and the discharge space being connected to an accept discharge conduit, and foil blades being connected to the rotor so that they wipe the surface of the screen cylinders on the side of the respective inlet space.

Fibre suspension is treated by screening it before it is introduced into a paper machine or the like in order that various impurities, splinters and other particles deteriorating the quality of the web to be produced could be removed. Normally this takes place by using a screen cylinder having perforations such in shape and size that an accepted fraction, i.e. accept, is able to pass through the perforations as easily as possible, while too large fibres and impurities are not able to pass through. The perforations of the screen cylinder may be round or elongated holes or parallel slits formed in the surface. In practice, in order that the capacity of the screen would remain high enough, the perforations have to be larger than what is actually required by the acceptable size of fibre. As a result, splinters, fibre bundles and other impurities always enter through the screen to some extent, which requires screening at several stages in order that sufficient purity could be obtained. Correspondingly, irrespective of the size of the perforations, some accept is always carried out with the reject, and the reject then has to be screened again for recovering and recycling the accept.

To simplify the screening process and to make it more effective, attempts have been made to provide various screens or filters, where the screening takes place at several different stages. Such devices are described e.g. in Finnish Patent Application 309/67 and Finnish Published Specifications 47789 and 51221.

Finnish Patent Application 309/67 discloses a device comprising two screening units connected functionally one after the other. In the device, suspension to be screened is introduced into the first screen, into the discharge conduit of which accept is passed. Rejected fraction i.e. reject is then diluted by water and passed to the second screening stage, from which accept is again passed into a discharge conduit while reject is discharged through another conduit. This solution requires addition of water to the fibre suspension, which increases the amount of water to be treated later on and calls for extra measures in order that the fibre suspension to be introduced through the head box would have a suitable density.

Finnish Published Specification 47789 in turn discloses a device similarly comprising two screening stages connected in series. The functional interconnection of these stages, however, deviates from that described above. In this solution the fibre suspension to be screened is introduced into the first screening stage and reject is removed from it. Accept is then passed to the second processing stage, from which reject is again removed and accept is passed onwards to subsequent processing stages. In this solution, too much accept is carried away with the reject, which requires a new separate reject screening stage.

Finnish Published Specification 51221 discloses a solution where a second screening surface is provided between the reject conduit and the suspension to be screened. Liquid and some fibres are able to return into the suspension to be screened through the second screening surface. In practice, this solution corresponds to a solution where reject is passed to a second separate screening stage, and the accept obtained from the second stage is recycled and mixed with new fibre suspension to be introduced into the first screening stage. The device, however, is very unreliable in operation as the passing of liquid and fibres from the reject conduit into the fibre suspension introduction space requires that a pressure difference should occur between them, which, in practice, is contrary to the pressure structure of the device. Accordingly, even though the device utilizes impulse-generating blades for wiping the surface of the reject screen, no appropriate secondary screening will take place and hardly any real benefit is obtained.

The object of the present invention is to provide a method and a pressure screen for screening fibre suspension which avoid the above difficulties and provide efficient multi-stage screening in a single screen. The method according to the invention is characterized in that accept from the first screening stage is passed to the second screening stage through a conduit formed within a rotor of the screen, that reject from the second screening stage is returned to the supply side of the first screening stage for rescreening, and that reject is removed from the screen only from the first screening stage.

The pressure screen according to the invention is characterized in that a pumping space is formed within the rotor so as to extend through it between the first intermediate space and the second inlet space, the first intermediate space and the second inlet space communicating through said pumping space, that pumping blades connected to the rotor for rotation with it are provided between the pumping space and the second inlet space, said pumping blades pumping accept obtained from the first screening stage from the pumping space to the second inlet space.

An essential feature of the invention is that fibre suspension is screened at two successive screening stages so that reject from the second screening stage is returned directly to the supply side of the first screening stage through the rotor of the screen. An essential feature of the device is that accept from the first screening stage is passed through a space formed centrally in the rotor to the supply space of the second screening stage, and the rotor further comprises a pumping blade assembly which creates a flow of suspension through the screening stages.

An advantage of the invention is that fibre suspension can be screened efficiently by a single multi-stage screen forming an integral whole, while the number of pipings and valves required for screening is reduced, less pumping is required, and the consumption of energy decreases. A further advantage of the invention is that the device needs less electrification and instrumentation and less space with a resulting decrease in investment costs.

In the following the invention will be described more closely with reference to the attached drawings, where FIG. 1 is a schematic view of one embodiment of the pressure screen according to the invention;

Figure 1:
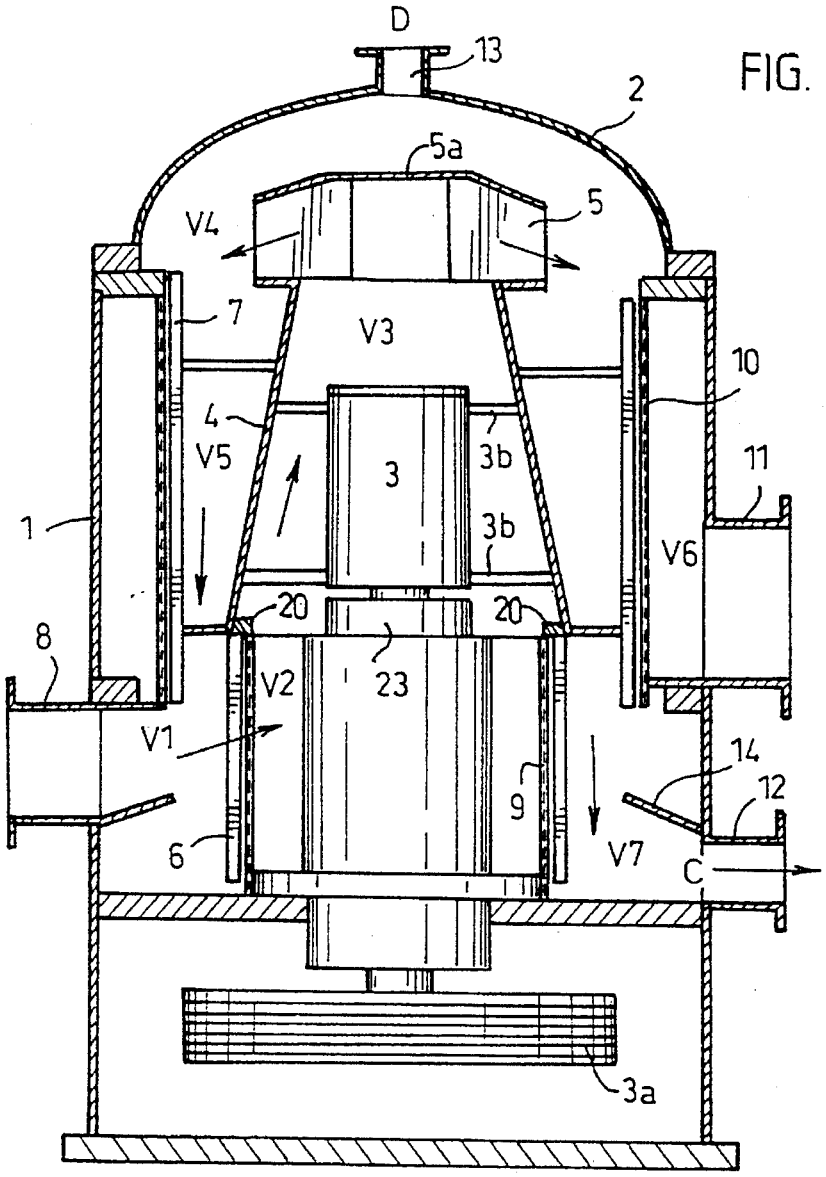

FIG. 1 shows schematically a structural embodiment of the pressure screen according to the invention. In the other figures, the same reference numerals as in FIG. 1 are used for the corresponding parts, so they will not be explained again below. The device comprises functionally corresponding parts and components which in the description of the figures are specified with the ordinal numbers first, second, third, etc., irrespective of the way in which these parts or components are associated with and connected to the functional process of the device. As used in the claims, the definitions furnished with an ordeal number first, second and third have to be interpreted as defined in the specification instead of regarding them as terms describing the order of the flow process of the fibre suspension and its screening.

The pressure screen comprises a body having a housing 1 and a top portion formed by a cover 2. Within the body a rotor 3 is mounted for rotation in a manner known per se, e.g. by utilizing a motor (not shown in the figures) and V-belts (not shown) provided between the motor and a belt pulley 3*a*. At one end of rotor 3, that is, at its upper end in the figure, a casing-like rotor frame 4 is positioned. Frame 4 is connected to rotor 3 by arms 3*b*, and it is cylindrical or conical in shape and hollow in the middle. Furthermore, pumping blades 5 acting as pumping means are attached to one end of rotor frame 4, and a cover plate 5*a* is positioned upon the blades. Foil blades 6 and 7 are further attached to rotor frame 4. Fibre suspension is introduced through a supply conduit 8 leading into a first inlet space V1 belonging to the first screening stage of the screen. The inner surface of inlet space V1 is defined by a first screen cylinder 9 which is provided at a first end of the screen and through the perforations of which an acceptable fraction of the suspension, called accept, flows into a first intermediate space V2 inside screen cylinder 9. From intermediate space V2 the accept flows from between the shaft of rotor 3 and its casing-like frame 4 onwards, that is, upwards in the figure, into a pump space V3. When rotor 3 rotates, blades 5 force the fibre suspension into a second intermediate space V4. From the second intermediate space V4, which is positioned towards the second end of the screen from the first screen cylinder 9, that is, in the upper portion of the screen in the figure, the accept further flows into a second inlet space V5 belonging to the second screening stage. The inner surface of the second inlet space is defined by the casing-like frame 4 of the rotor, and its outer surface is defined by a second screen cylinder 10 positioned in the axial direction at a distance from the first end of the screen towards the second end of the screen. At the second screening stage, the accept flows through the perforations of the second screen cylinder 10 into a discharge space V6 formed between housing 1 and the second screen cylinder 10. From discharge space V6 the accept is removed through a discharge conduit 11. From the second inlet space V5, the reject, i.e. the suspension rejected from the second screening stage, is passed onwards by a pressure effect created by pump blades 5, that is, downwards in the figure, so that it returns into the first inlet space V1 and is thus again screened through the first screen cylinder 9. The remaining reject is removed into a reject space V7, which is separated from inlet space V1 by an annular or conical plate 14. The reject is carried further through a conduit 12. To the second intermediate space V4 is further connected a conduit 13, through which air possibly formed in the screen can be discharged. Conduit 13 may also be used for the discharge of so-called light reject from the screen. During the rotation of rotor 3, foil blades 6 and 7 attached to rotor screen 4 also rotate, thus wiping the surface of screen cylinders 9 and 10 on their supply side so that reject and fibres gathered on the surface are loosened and return to the fibre suspension in a known manner. The screen shown in the figure further requires a shaft seal 23, which seals the rotor shaft so that fibre suspension and liquid contained in the fibre suspension will not flow into the bearing of the rotor shaft. Moreover, a seal 20 has to be provided between the upper edge of screen cylinder 9 and the rotor frame 4 so as to prevent the flow of fibre suspension contained in inlet space V1 between screen cylinder 9 and rotor frame 4.

Figure 2:
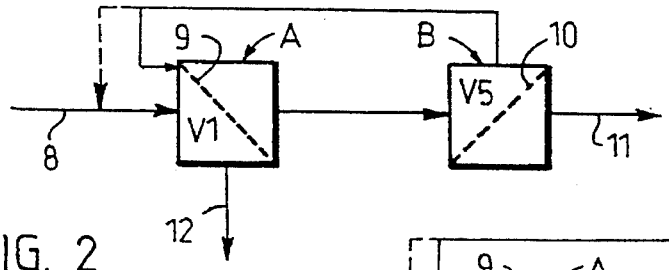
FIG. 2 illustrates schematically the operation of one application of the pressure screen shown in FIG. 1.

FIG. 2 shows an operational diagram for the pressure screen shown in FIG. 1. Fibre suspension to be screened is introduced into the pressure screen through conduit 8. In FIG. 2, and in FIGS. 3, 5 and 8 to be discussed below, the screen cylinders of FIGS. 1, 4, 6 and 7, respectively, are indicated schematically with a slanting broken line and they are designated with the same reference numerals as the screen cylinders of FIGS. 1, 4, 6 and 7, respectively. After the first screening stage A, accept passes to the second screening stage B, whereas reject is discharged from the pressure screen through conduit 12. At the second screening stage B, reject is returned into the suspension to be screened e.g. into supply conduit 8 or the first inlet space V1. In the solution the incoming fibre suspension can first be screened roughly at a screening stage where the screen perforations are larger than usual, whereby less accept than previously is discharged with the reject, while the first screening stage has a good capacity. The second screening stage B in turn utilizes a normal screen perforation size, whereby accept contained in the reject returned to stage A for screening will not be wasted but it is recovered in the pressure screen. The accept discharged from the second screening stage B is of a high quality and contains considerably less splinters or fibre bundles than previously, as the splinters and fibre bundles are removed from the suspension efficiently at the two stages.

Figure 3:
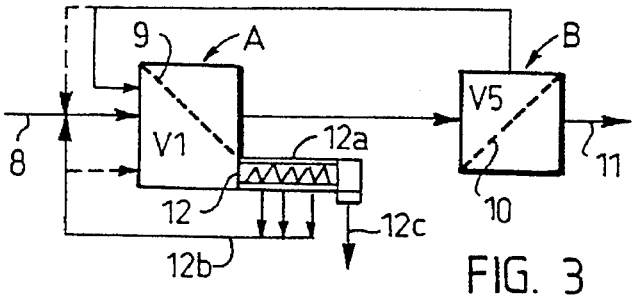
FIG. 3 illustrates schematically the operation of another application of the pressure screen shown in FIG. 1.

The operational diagram for the pressure screen shown in FIG. 3 corresponds otherwise to that shown in FIG. 2 except that it comprises a screw press 12*a* (not shown in FIG. 1) mounted in the inlet end of the reject discharge conduit. The screw press dewaters reject. Reject having a density as high as 20% or even more is discharged through a conduit 12*c*, and the filtrate is passed through a conduit 12*b* back to the material inlet or into inlet space V1.

Figure 4:
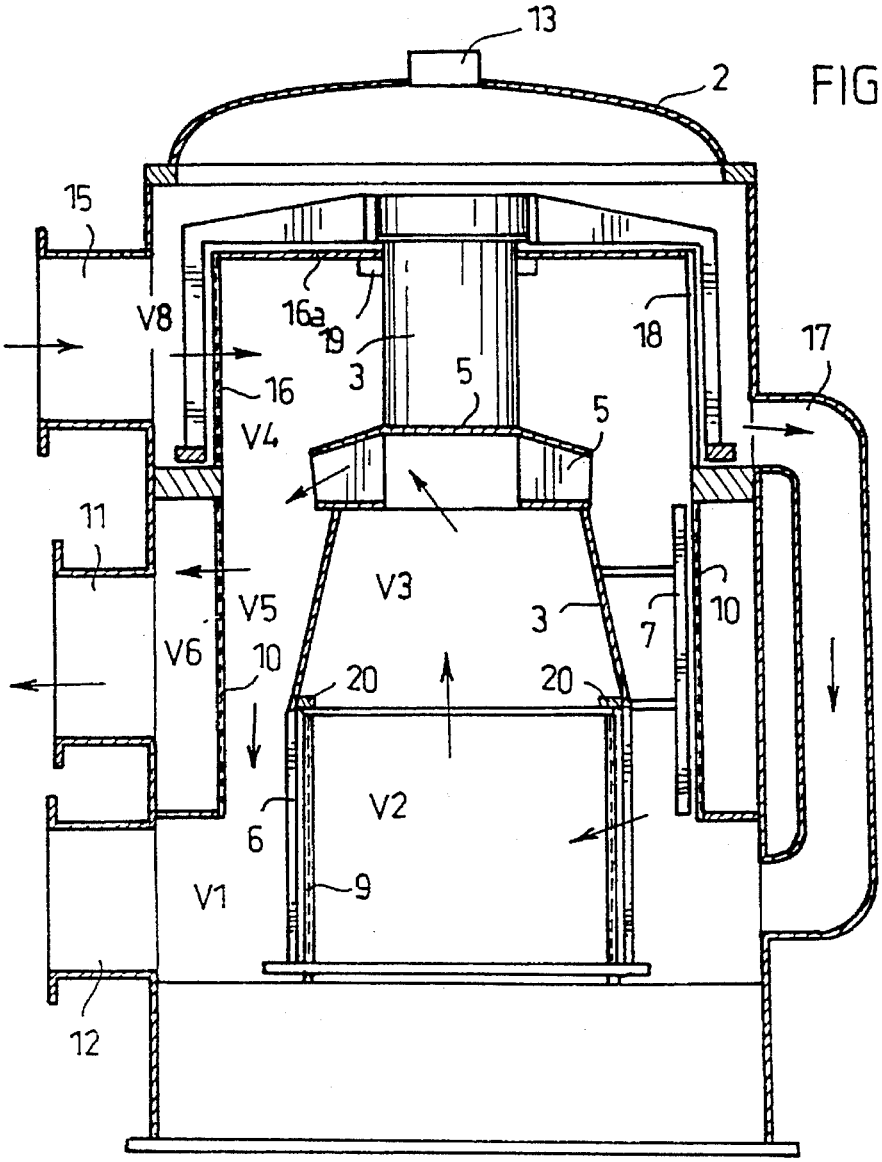
FIG. 4 is a schematic view of another embodiment of the pressure screen according to the invention.

FIG. 4 shows another embodiment of the pressure screen according to the invention, where the same reference numerals as in FIG. 1 are used for the corresponding parts. In the pressure screen of FIG. 4, fibre suspension is introduced through a supply conduit 15, which is connected to a pre-screen, that is, a third inlet space V8 positioned at the second end of the pressure screen, in the upper part in the figure. The inner surface of inlet space V8 is defined by a third screen cylinder 16, the upper end of which is closed by a cover plate 16*a* for preventing the flow of material therethrough. The material fraction passed through screen cylinder 16, i.e. accept, is directly passed to the second screening stage, that is, through the second intermediate space V4 into the second inlet space V5. Reject from the pre-screening stage is passed through a separate conduit 17 extending outside the pressure screen into the first inlet space V1 belonging to the first screening stage, from where accept is passed through the first screen cylinder 9 into the first intermediate space V2 and further along the inside of rotor 3 through pump space V3 to the pump blades 5. The pump blades forward the accept through the second intermediate space V4 to the second inlet space V5 belonging to the second screening stage. From the second inlet space V5 the accept is passed through the second screen cylinder 10 into discharge space V6 and is discharged through conduit 11. Reject is again carried from the second inlet space V5 into the first inlet space V1, where it is mixed with the suspension contained in it so that it will again be screened in screen cylinder 9. The final reject is discharged from the first inlet space V1 through discharge conduit 12. The screen further comprises foil blades 18 connected to the rotor and positioned on the outside of the third screen cylinder 16. When rotor 3 rotates, the foil blades 18 wipe the surface of screen cylinder 16, thus loosening reject and other impurities from the surface in a known manner. In addition to the seals 20 and 23 shown in FIG. 1, the pressure screen shown in FIG. 4 further comprises a third seal 19, which seals off the rotor and the cover plate 16*a* relative to each other so that fibre suspension will not flow between them but always flows through the screen cylinders. FIG. 4 does not show the rotation mechanism or the motor of the rotor as they have already been shown partly in FIG. 1 and are as such widely known.

Figure 5:
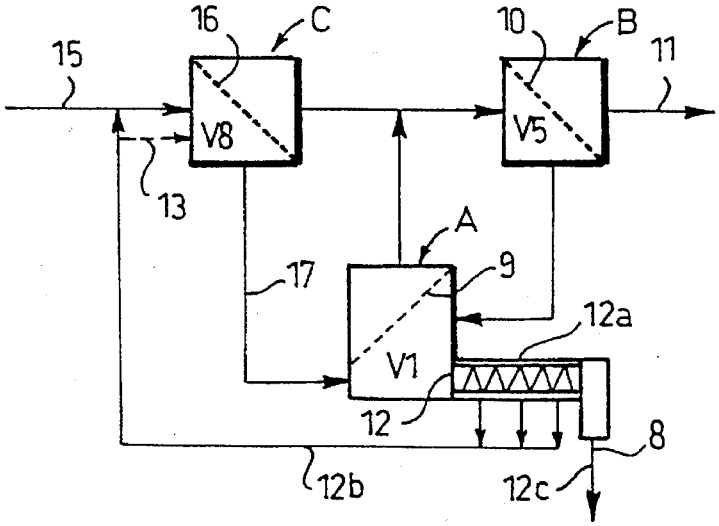
FIG. 5 illustrates schematically the operation of the pressure screen shown in FIG. 4.

FIG. 5 shows an operational diagram for the pressure screen shown in FIG. 4. Fibre suspension is introduced into the screen through conduit 15 to pre-screening stage C, from which accept is passed directly into the second screening stage B. Reject is passed from pre-screening stage C through conduit 17 to the first screening stage A, from which accept is passed similarly in accordance with the invention to the second screening stage B. From screening stage B accept flows out through conduit 11, and reject is returned to screening stage A, where it is again mixed with new reject from the pre-screen and rescreened with it. Final reject is removed through conduit 12. As shown in FIG. 5, the device may further comprise a screw press 12*a* (not shown in FIG. 4), which squeezes liquid out of the reject, and the filtrate is then returned through conduit 12*b* to the material inlet either through conduit 15 or, if desired, directly into the pre-screen C, e.g. through a connection 13 shown in FIG. 5. Reject having a density as high as 20% or even more is discharged through conduit 12*c*.

Figure 6:
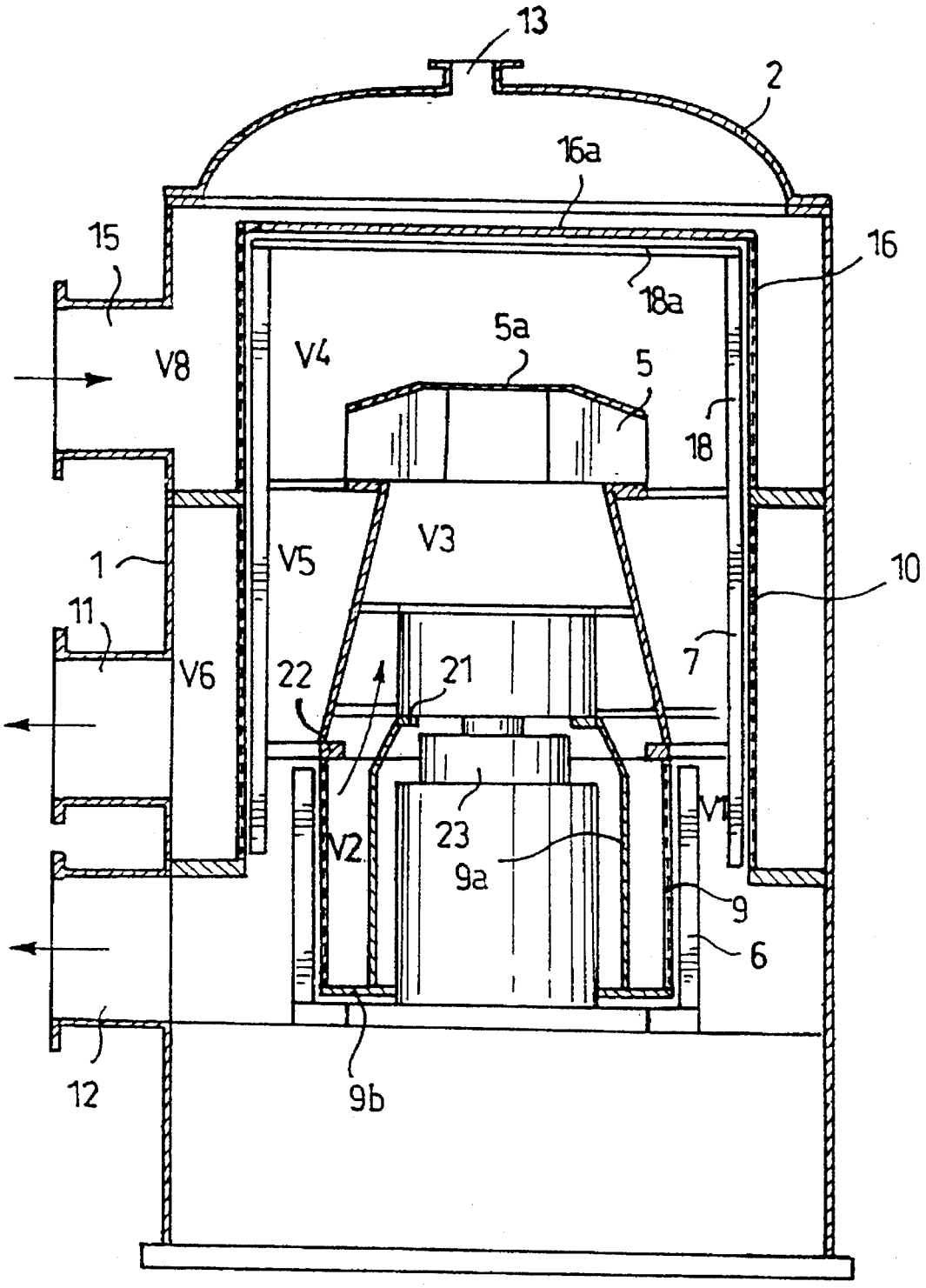
FIG. 6 is a schematic view of a further embodiment of the pressure screen according to the invention.

FIG. 6 shows a solution corresponding functionally to the pressure screen shown in FIGS. 4 and 5. This solution avoids the use of the seals 19 and 20 while it nevertheless provides an equal screening capacity. In this case, the foil blades 18 cleaning screen cylinder 16 of screening stage C are positioned in intermediate space V4 instead of inlet space V8, and cover plate 16*a* at the end of screen cylinder 16 closes the intermediate space entirely, and so seal 19 shown in FIG. 4 is not needed. The foil blades 18 in turn are supported by support means 18*a* at the upper end. Similarly, screen cylinder 9 may be arranged to rotate with the rotor at screening stage A by using a cylindrical casing 9*a* and an interconnecting annular part 9*b*, whereby the screen cylinder and the rotor can be easily sealed relative to each other by seals 21 and 22. The foil blades 6 cleaning screen cylinder 9 are thereby attached integral with the screen body, thus avoiding the seal indicated by the reference numeral 20 in the solutions shown in FIGS. 1 and 4.

Figure 7:
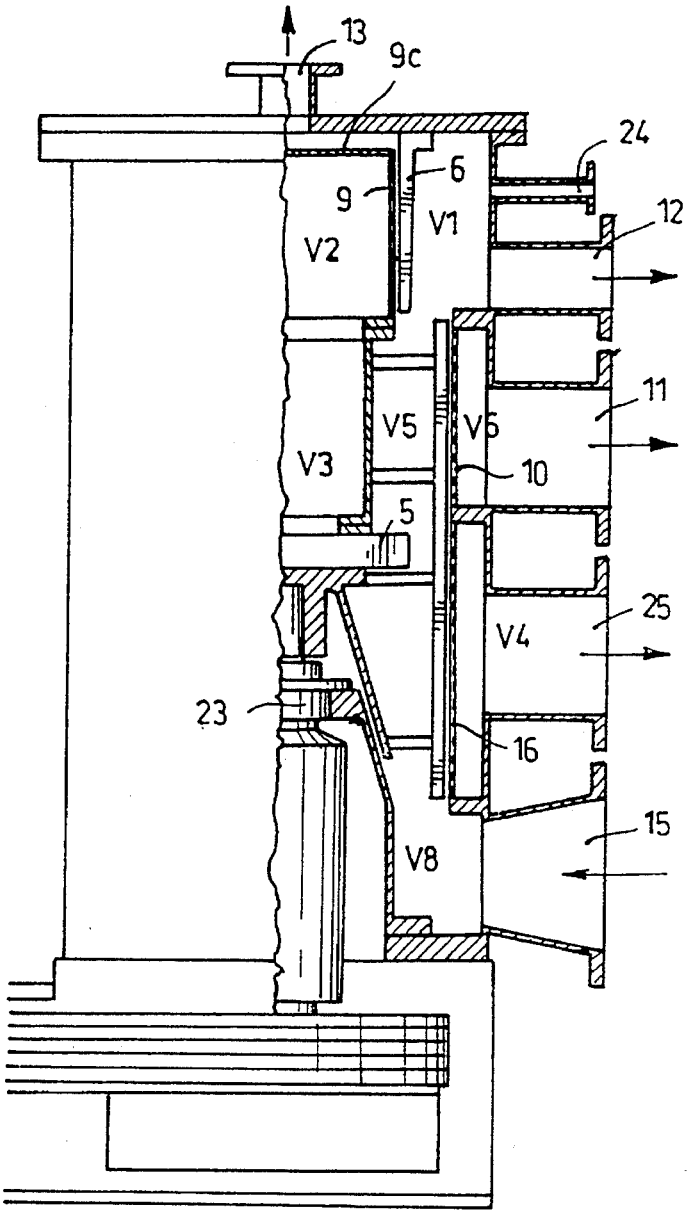
FIG. 7 is a schematic view of still another embodiment of the pressure screen according to the invention.
Figure 8:
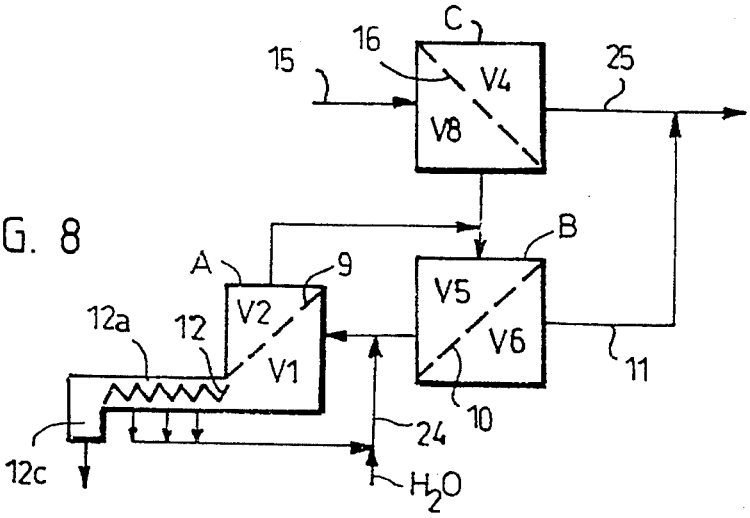
FIG. 8 illustrates schematically the operation of the screen shown in FIG. 7.

FIG. 7 shows still another embodiment of the screen, and FIG. 8 shows an operational diagram for this embodiment. In this embodiment, the direction of flow in the screen is opposite to that of the screens shown in FIGS. 1, 4 and 6, i.e. fibre suspension flows in this case from the bottom to the top. In this embodiment, fibre suspension is passed through a supply conduit 15 into the third inlet space V8, from which accept passed through the third screen cylinder 16 is discharged into the annular second intermediate space V4 and further directly out through conduit 25. Reject in turn passes from inlet space V8 to screening stage B, i.e. to the second inlet space V5, from which reject flows through the second screen cylinder 10 into the annular discharge space V6 and further out through conduit 11, whereby the conduits 11 and 25 can be interconnected by an external piping not shown. From the second inlet space V5 the reject flows into the first inlet space V1 and further through the first screen cylinder 9, whereby the remaining reject is discharged through discharge conduit 12 connected to the first inlet space V1. The material entering inlet space V1 can be further diluted by water supplied from a water supply conduit 24 connected to the inlet space. Material that has passed through the first screen cylinder 9 is carried through intermediate space V2 in the rotor onwards into pump space V3, from which the pump blades 5 pass it again into the second inlet space V5 for rescreening. In FIG. 7, the first screen cylinder 9 is also arranged to rotate with the rotor. Accordingly, the foil blades are fixed. A solid closing cover 9*c* is provided at the end of screen cylinder 9. The cover prevents the flow of fibre suspension through the end of the screen cylinder inside it and thus inside the rotor. This solution also avoids the use of all of the annular seals between the screen cylinders and the other components with the exception of the normal shaft seal 23 of the rotor. The operational reliability of the device is thus good, and the material will flow in an appropriate manner.

FIG. 8 illustrates diagrammatically the operation of the screen shown in FIG. 7. It appears from the figure how fibre suspension is introduced through conduit 15 to screening stage C, from which accept is discharged through screen cylinder 16 into intermediate space V4 and further out through conduit 25. Reject is passed to screening stage B, from which accept is discharged through screen cylinder 10 into space V6 and further onwards through conduit 11. Correspondingly, reject is passed from space V5 to screening stage A into the respective inlet space V1, from which accept is discharged through screen cylinder 9 into space V2 and is further returned into inlet space V5 of screening stage B. In FIG. 8, the screw structure provided for screening stage A corresponds to the screw structure shown in FIG. 5, even though the structure is not shown in FIG. 7 and FIG. 4, respectively.

The invention has been described above and shown in the drawings by way of example, and it is not in any way restricted to these embodiments, but the scope of protection is defined in the attached claims. Even though the foil blades in the embodiments shown in the figures are positioned on the screen cylinder surface on the material supply side only, foil blades can also be arranged to rotate along the discharge surface of the screen cylinders and on both the supply side and discharge side surface without affecting the scope of protection of the claims in any way. Even though pressure screens are shown in the vertical direction in the figures, they may be mounted in the vertical or horizontal direction. Also, the main direction of flow of fibre suspension may be arranged to take place either from the bottom upward or from the top downward, depending on the space available and other requirements.

I claim:

1. Method for screening fibre suspension at separate screening stages provided in a single pressure screen, wherein accept from the first screening stage is passed to the second screening stage, accept from the second screening stage and reject formed in the screening are removed from the pressure screen so that accept from the first screening stage is passed to the second screening stage through a conduit formed within a rotor of the screen, reject from the second screening stage is returned to the supply side of the first screening stage for rescreening, and reject is removed from the screen only from the first screening stage.

2. Method according to claim 1, wherein fibre suspension to be screened is first introduced into an inlet space for the first screening stage.

3. Method according to claim 1, wherein fibre suspension is first introduced to a pre-screening stage provided in the same pressure screen, accept from the pre-screening stage is passed directly to the second screening stage, and reject from the pre-screening stage is passed to the first screening stage, from which accept is passed to the second screening stage for rescreening together with the accept from the pre-screening stage.

4. Method according to claim 1, wherein the fibre suspension is first introduced to a pre-screening stage provided in the same pressure screen, and accept from the pre-screening stage is removed from the screen, reject from the pre-screening stage is passed to the second screening stage, accept from the second screening stage is passed out of the screen and reject from it passed to the first screening stage, from which accept is returned to the second screening stage for rescreening together with the reject from the pre-screening stage.

5. Method according to claim 1, wherein accept from the first screening stage is pumped to the second screening stage by pumping means provided in the rotor of the screen.

6. Method according to claim 1, wherein reject removed from the first screening stage is thickened mechanically by a screw press, and a filtrate separated in the thickening step is returned to one of the screening stages for diluting the fibre suspension to be introduced into it.

7. Pressure screen for screening fibre suspension, comprising a housing, a rotor mounted for rotation within the housing, a first inlet space formed within the housing and defined on one side by a first screen cylinder, a first intermediate space formed on the other side of the first screen cylinder, a second inlet space defined on one side by a second screen cylinder mounted coaxially with the first screen cylinder, a discharge space formed outside the second screen cylinder, and a supply conduit for introducing fibre suspension to be screened into the screen, the first intermediate space communicating with the second inlet space for passing accept passed through the first screen cylinder to the second screen cylinder, the inlet space being connected to a reject discharge conduit and the discharge space being connected to an accept discharge conduit, and foil blades being connected to the rotor so that they wipe the surface of the screen cylinders on the side of the respective inlet space, wherein a pumping space is formed within the rotor so as to extend through it between the first intermediate space and the second inlet space, the first intermediate space and the second inlet space communicating through said pumping space, that pumping blades connected to the rotor for rotation with it are provided between the pumping space and the second inlet space, said pumping blades pumping accept obtained from the first screening stage from the pumping space to the second inlet space.

8. Pressure screen according to claim 7, wherein the first screen cylinder is positioned at a first end of the pressure screen, and the first inlet space is positioned cylindrically around the first screen cylinder, the second screen cylinder is larger in diameter than the first screen cylinder and positioned in the axial direction of the pressure screen at a distance from the first end of the pressure screen, the second inlet space is formed inside the second screen cylinder between it and the rotor so that the first and the second inlet space are positioned axially one after the other and communicate with each other, and the first intermediate space and the pumping space are formed inside the first screen cylinder so as to form together a single space.

9. Pressure screen according to claim 8, wherein a cover plate is mounted on one side of the pumping blades at a distance away from the pumping space, the cover plate preventing the flow of material from the pumping space directly in the direction of the rotor shaft.

10. Pressure screen according to claim 7, wherein a third screen cylinder is mounted between the second end of the screen and the second screen cylinder, and a third inlet space into which fibre suspension to be screened is first introduced is formed outside the third screen cylinder, the inside of the third screen cylinder is arranged to communicate with the second inlet space for passing the accept passed through the third screen cylinder to the second screening stage, and the third inlet space is arranged to communicate with the first inlet space by a separate conduit for passing reject removed from the pre-screening stage through the first inlet space to rescreening.

11. Pressure screen according to claim 7, wherein a third screen cylinder is mounted between the second end of the screen and the second screen cylinder, and a third inlet space into which fibre suspension to be screened is first introduced is formed inside the third screen cylinder, the third inlet space is arranged to communicate with the second inlet space for passing reject that has not passed through the third screen cylinder to the second screening stage, and accept that has passed through the third screen cylinder is passed out of the screen through a second accept discharge conduit.

12. Pressure screen according to claim 10, wherein the third screen cylinder and the second screen cylinder are equal in diameter and mounted immediately one after the other in the axial direction.

13. Pressure screen according to claim 12, wherein foil blades wiping the inner surface of the second screen cylinder and the third screen cylinder are integral in the axial direction.

14. Pressure screen according to claim 10, wherein the first screen cylinder is mounted for rotation with the rotor, and the foil blades wiping the surface of the first screen cylinder are mounted against motion relative to the pressure screen.

15. Pressure screen according to claim 11, wherein the third screen cylinder and the second screen cylinder are equal in diameter and mounted immediately one after the other in the axial direction.

* * * * *